US006443754B2

(12) United States Patent
Hatagishi et al.

(10) Patent No.: US 6,443,754 B2
(45) Date of Patent: Sep. 3, 2002

(54) PRESSURE CONNECTING TERMINAL

(75) Inventors: Yuji Hatagishi; Akira Maeda, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/785,262

(22) Filed: Feb. 20, 2001

(30) Foreign Application Priority Data

Feb. 21, 2000 (JP) ..... P2000-042809

(51) Int. Cl.[7] ..... H01R 11/20

(52) U.S. Cl. ..... 439/397; 439/398; 439/399; 439/407; 439/406

(58) Field of Search ..... 439/397, 398, 439/399, 387, 406, 407

(56) References Cited

U.S. PATENT DOCUMENTS 4,940,425 A * 7/1990 Hass et al. ..... 439/397
4,948,382 A * 8/1990 Marpoe, Jr. et al. ..... 439/397
6,007,365 A * 12/1999 Atsumi et al. ..... 439/397
6,077,103 A * 6/2000 Saka et al. ..... 439/397

FOREIGN PATENT DOCUMENTS

JP 7-22468 4/1995

* cited by examiner

*Primary Examiner*—Tho D. Ta
(74) *Attorney, Agent, or Firm*—Finnegan, Henderson, Farabow, Garrett, & Dunner, L.L.P.

(57) ABSTRACT

A coated wire crimping portion 13 having a pair of grip pieces 16, 16 is provided on one side of a pressure connecting terminal 11, in which a coated wire 10 is connected to the other side by pressure. This other side includes a first pressure connecting portion 14 comprising a pair of punched blades 17, 17 each having a plated face and a second pressure connecting portion 15 which is an erected piece 19 on a bottom wall 11*a*between the first pressure connecting portion 14 and the pair of the grip pieces 16, 16 while supported by a pair of side wall portions 11*b*, 11*b*, so that the coated wire 10 pressed into a slit formed from a top end thereof toward the bottom wall 11*a* is prevented from moving in the axial direction so as to secure a conductive connection.

1 Claim, 2 Drawing Sheets

PRESSURE CONNECTING TERMINAL

BACKGROUND OF THE INVENTION

1. Field of the Invention

The present invention relates to a pressure connecting terminal to be connected to a wire terminal.

2. Description of the Related Art

FIG. 1 is a perspective view showing an example of a conventional pressure connecting terminal. This pressure connecting terminal 1 is formed by punching and bending a plated conductive metal plate, and basically has a substantially U-shaped section consisting of bottom wall 1*a* and both side walls 1*b*, 1*b*. It has a cylindrical and electric contact portion 2 provided on a front portion in the length direction and a pressure connecting portion 3 provided on a rear portion thereof, to which a coated wire is to be connected by pressure.

The pressure connecting portion 3 has a pair of pressure connecting blades 4, 4 erected from a bottom wall 1*a* and provided in the back and forth direction. There are slits 5, 5 in the pressure connecting blades 4, 4 such that they are cut downward from the center at a top end of each thereof.

In the pressure connecting portion 3, a wire insertion portion 6 is formed in the length direction by punching out and remaining right and left portions act as bridge portions 7, 7 for joining top ends of the pressure connecting blades 4, 4. Shoulder portions 8, 8 protruded outward are formed on these bridge portions 7, 7 and the shoulder portions 8, 8 are fit to fitting grooves 9, 9 formed by cutting top edge portions of both side walls 1*b*, 1*b*.

For the pressure connecting portion 3, a U-shaped cut-in is formed in the bottom wall 1*a* such that two long sides extending in the length direction toward an electric contact portion 2 and a front side are continuous with each other and then, that the cut portion is drawn to a rear side remaining on the bottom wall 1*a* of the pressure connecting portion 3 so that it is bent three-dimensionally in the substantially reverse U shape (see Japanese Utility Model Application Laid-Open No. 7-22468).

When connecting a coated wire to the pressure connecting portion 3 of the above described pressure connecting terminal 1, the coated wire is pushed into between the pair of the pressure connecting blades 4, 4 in the wire insertion portion 6 from above.

Because the pressure connecting blades 4, 4 provide broken faces formed by cutting the bottom wall 1*a*, it is necessary to carry out plating during or after assembly of the pressure connecting terminal 1 in order to secure electric connecting reliability. For the reason, production process of the pressure connecting terminal 1 becomes complicated thereby leading to an increase of production cost.

Further, because the coated wire is connected to the pressure connecting portion only through the pressure connecting blades 4, 4, there is such a fear that pressure connecting force weakens to increase resistance thereby causing unconductivity when an external force such as a pulling force is applied to the coated wire. That is, there is a problem that its mechanical connecting reliability is low.

SUMMARY OF THE INVENTION

An object of the present invention is to provide a pressure connecting terminal capable of improving both electrical connecting reliability and mechanical connecting reliability and which can be produced at low cost.

To achieve the above object, according to the present invention, there is provided a pressure connecting terminal comprising: an electric contact portion provided on a side thereof for contacting a mating terminal; a pair of side wall portions formed on the other side by bending both sides of a bottom wall while an end of a coated wire being connected and conductive therewith; a coated wire crimping portion comprising a pair of grip pieces extended from the pair of the side wall portions so that the coated wire is to be crimped; a first pressure connecting portion provided between the coated wire crimping portion and the electric contact portion, which is located on the side of the electric contact portion and comprises a pair of punched blades each having a plated face formed by protruding the pair of the side wall portions inward, so that the coated wire is to be pressed in between the punched blades to secure conductive connection; and a second pressure connecting portion comprising an erected piece raised between the first pressure connecting portion and the pair of the grip pieces such that the erected piece is erected by being supported by the pair of the side wall portions on the bottom wall, so that the coated wire pressed in a slit formed from a top end thereof toward the bottom wall is prevented from moving in an axial direction so as to secure conductive connection.

In this pressure connecting terminal, an end of the coated wire is connected to the first pressure connecting portion and the second pressure connecting portion by pressure and by crimping the coated wire by the grip pieces. Further, the core of the wire is brought into contact with a pair of the punched blades each having a plated face in the first pressure connecting portion so as to secure a conductivity. Further, moving of the coated wire in the axial direction is restricted by the erected piece to which the coated wire is connected by pressure in the second pressure connecting portion. Thus, even if an external force is applied in the direction for the end of the coated wire to leave the pressure connecting terminal, most of this external force is supported by the second pressure connecting portion so that the external force can be prevented from being applied to the first pressure connecting portion. Therefore, both electric connecting reliability and mechanical reliability are improved.

According to the invention, there is provided a pressure connecting terminal according to the first aspect wherein the erected piece is formed by cutting the bottom wall in the U shape and raising it in the direction of an opening and has a pair of shoulder portions engaging with fitting grooves formed in the pair of the side wall portions, on both sides of the erected piece.

In this pressure connecting terminal, because the erected piece is formed by cutting part of the bottom wall, the erected piece can be fixed more firmly between the pair of the side wall portions and when the coated wire is connected to the second pressure connecting portion by pressure, moving of the coated wire in the axial direction can be restricted more securely. As a result, an external force applied to the first pressure connecting portion can be further reduced. Further, because part of the bottom wall is only bent and supported by the pair of the side wall portions, production of this pressure connecting terminal is very easy.

According to the present invention, there is provided a pressure connecting terminal according to the first aspect wherein the erected piece comprises a pair of bent pieces formed by cutting the pair of the side wall portions in the U shape and bending them inward, so that the slit is formed between the bent pieces.

In this pressure connecting terminal, because the erected piece is formed of the pair of the bent pieces formed by cutting partly each of the pair of the side wall portions, the erected piece can be formed more firmly over the bottom wall, so that the moving of the coated wire in the axial direction can be restricted more securely. Further, because the erected piece can be formed by cutting partly the pair of the side wall portions, production of the pressure connecting terminal is facilitated.

DETAILED DESCRIPTION OF THE PREFERRED EMBODIMENTS

Hereinafter, the embodiments of the present invention will be described in detail with reference to FIGS. 2 and 3.

Figure 1:
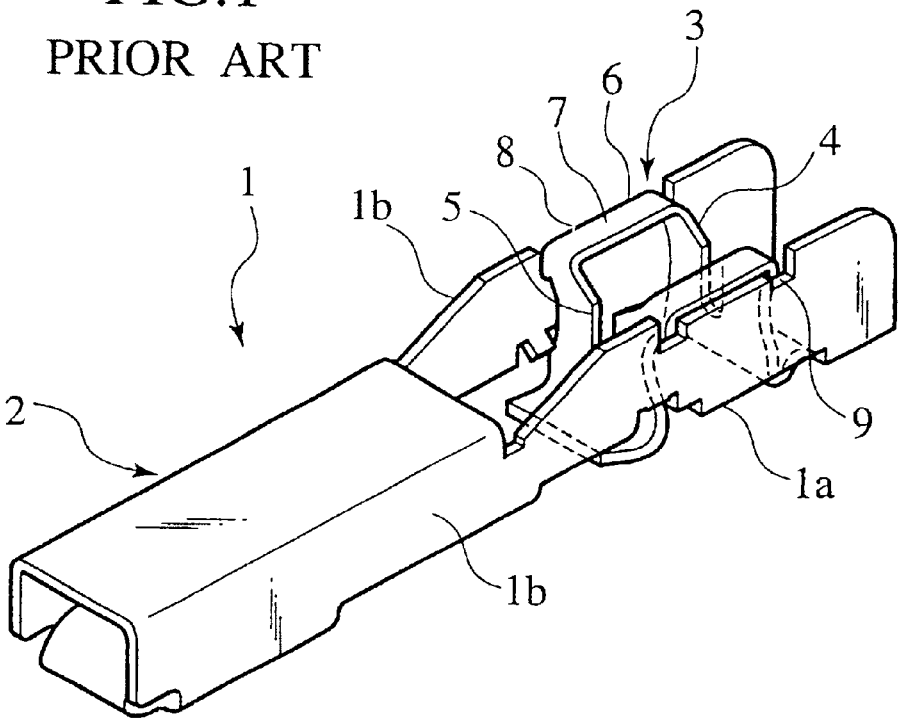
FIG.1 PRIOR ART
FIG. 1 is a perspective view showing a conventional pressure connecting terminal.
Figure 2:
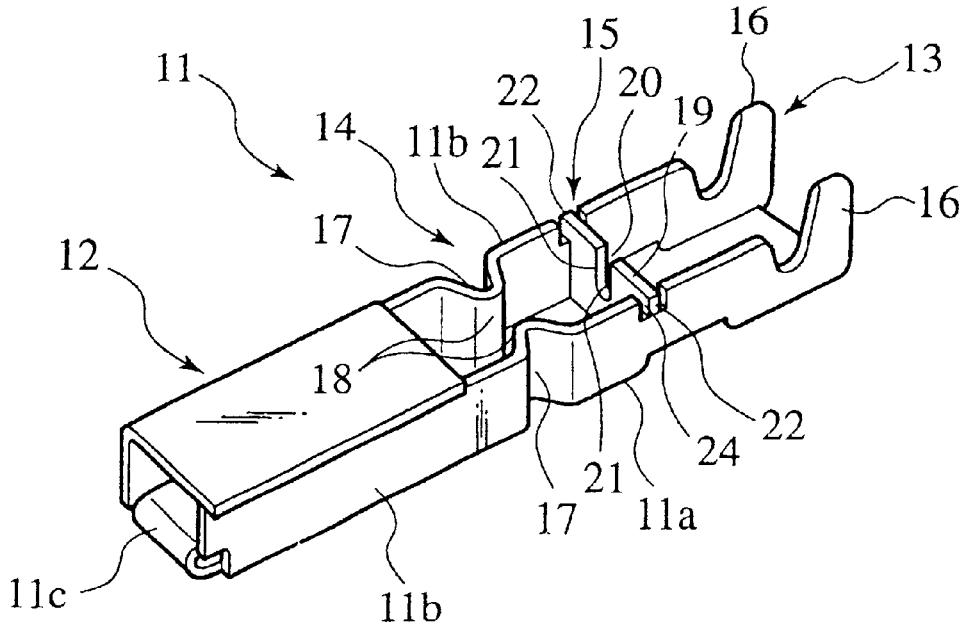
FIG. 2 is a perspective view showing a pressure connecting terminal according to an embodiment of the present invention.

FIG. 2 is a perspective view showing a pressure connecting terminal according to an embodiment of the present invention. FIG. 3 is a plan view of the pressure connecting terminal shown in FIG. 2.

Figure 3:
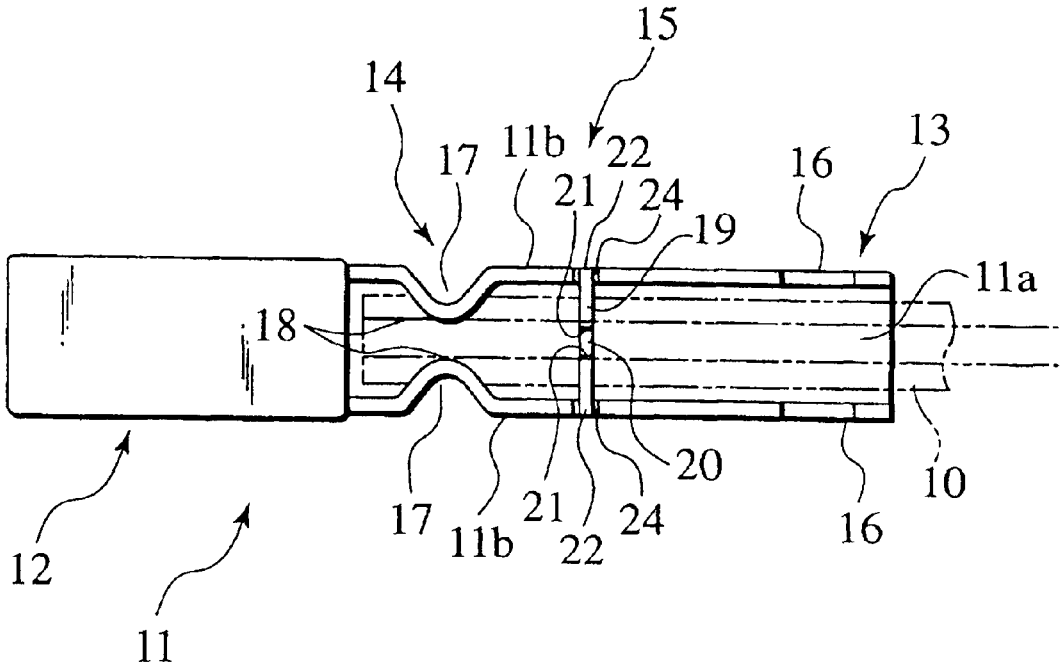
FIG. 3 is a plan view showing a pressure connecting terminal according to the embodiment of the present invention.

As shown in FIGS. 2 and 3, a pressure connecting terminal 11 of this embodiment is formed by punching out a plated conductive metal plate and then bending that punched plate. Basically, this pressure connecting terminal has a substantially U-shaped section comprising a bottom wall 11*a* and a pair of side wall portions 11*b*, 11*b* extended from both sides of the bottom wall 11*a*. This pressure connecting terminal 11 has an electric contact portion 12 for making contact with a mating terminal provided on one side and a pressure connecting portion 20 on which a terminal of a coated wire 10 is to be welded with pressure and connected, provided on the other side thereof.

The electric contact portion 12 is formed in a cylindrical shape by bending extended portions of both side wall portions 11*b*, 11*b* inward such that they overlap each other and has a pressure bar spring bent side portion 11*c* from a front end of the bottom wall 11*a* backward of the cylinder.

The pressure connecting portion 20 comprises a coated wire crimping portion 13 provided at a rear end, a first pressure connecting portion 14 provided between the coated wire crimping portion 13 and the electric contact portion 12 such that it is located on the side of the electric contact portion 12 and a second pressure connecting portion 15 provided between the first pressure connecting portion 14 and the coated wire crimping portion 13. The coated wire crimping portion 13 is formed of a pair of grip pieces 16, 16 right and left provided on the other end of each of the both side wall portions 11*b*, 11*b*. By bending this pair of the grip pieces 16, 16 inward in the form of an arc, the coated wire is held between the bottom wall 11*a* and these grip pieces 16, 16.

The first pressure connecting portion 14 is formed of a pair of punched blades 17, 17 right and left, which are protruded inward from the both side wall portions 11*b*, 11*b* such that they oppose each other. Inside faces of the protruded ends of these punched blades 17, 17 act as connecting portions 18, 18 in which the coated wire is to be inserted to achieve pressure connecting therewith. In this case, because the punched blades 17, 17 are formed by punching a pair of the side wall portions 11*b*, 11*b*, formed by bending a plated conductive metal plate, just inward, the surfaces of the connecting portions 18, 18 do not have broken faces but the plated surfaces, so that the surfaces have the excellent conductivity. The second pressure connecting portion 15 is provided between this first pressure connecting portion 14 and the pair of the grip pieces 16, 16.

The second pressure connecting portion 15 comprises an erected piece 19, which is erected by being supported by the pair of the side wall portions 11*b*, 11*b* on the bottom wall 11*a*, so that the coated wire is restricted from moving in the axial direction and held by a slit 20 formed in the erected piece 19 from a top end thereof toward the bottom wall 11*a* to ensure conductivity and connection. The erected piece 19 is formed by cutting the bottom wall 11*a* in the U shape and raised in the direction of an opening. Shoulder portions 22, 22 are formed on both sides of the top end of the erected piece 19 raised from the bottom wall 11*a*. These shoulder portions 22, 22 are engaged with rectangular fitting grooves 24, 24 provided in the pair of the sidewall portions 11*b*, 11*b*. Therefore, the erected piece 19 is prevented from falling down to the bottom wall 11*a*. The slit 20 is formed such that it is open at the top end between the shoulder portions 22, 22 and extended toward the bottom wall 11*a*. An inner side of this slit 20 acts as a connecting portion 21 which tears a coating portion of the coated wire 10 to secure conductivity and connection with a core of the wire.

When connecting the coated wire 10 by pressure to the pressure connecting terminal 11 described above, the coated wire 10 is placed along the pressure connecting terminal 11 and it is pressed into the first pressure connecting portion 14 and the second pressure connecting portion 15 from above. The coated wire 10 is connected to the connecting portions 18 of the punched blades 17, 17 at the first pressure connecting portion 14 and at the same time, the coating of the coated wire is torn by the inside portion of the slit 20 in the erected piece 19, so that the core is exposed, introduced into the slit and then connected by pressure to the connecting portion 21. Further, by crimping the grip pieces 16 at the coated wire crimping portion 13, the pressure connecting terminal 11 is connected to an end of the coated wire 10.

In the pressure connecting terminal 11 of this embodiment, the core of the coated wire is brought into contact with the pair of the punched blades 17, 17 each having the plated face at the first pressure connecting portion 14 so as to secure conductivity. Further, at the second pressure connecting portion 15, a moving of the coated wire 10 in the axial direction is restricted by the erected piece 19 to which the coated wire 10 is connected by pressure. Thus, even if an external force is applied in a direction for the end of the coated wire 10 to leave the pressure connecting terminal 11, most of this external force is supported by the second pressure connecting portion 15 to some extent and therefore, application of the external force to the first pressure connecting portion 14 can be prevented. Therefore, both electrical connecting reliability and mechanical connecting reliability are improved.

Because the first pressure connecting portion 14 is formed of the pair of the punched blades 17, 17 formed by protruding the both side wall portions 11*b*, 11*b*, formed by punching a plated conductive metal plate, inward such that they oppose each other, production process thereof can be simplified, so that this pressure connecting terminal can be produced at low cost.

Further, because the second pressure connecting portion 15 is the erected piece 19 formed by cutting the bottom wall

11*a* in the U shape, raising the cut portion in the direction of its opening and cutting the slit 20 from the end portion in the direction of the opening toward the bottom wall 11*a*, the production of the pressure connecting terminal is achieved at lower cost.

Although according to the above embodiment, the erected piece 19 is formed by raising it from the bottom wall 11*a*, this erected piece 19 may be formed of other member and fixed by the bottom wall 11*a* and a pair of the side wall portions 11*b*, 11*b*.

Next, other embodiment of the erected piece shown in FIG. 4 will be described.

Figure 4:
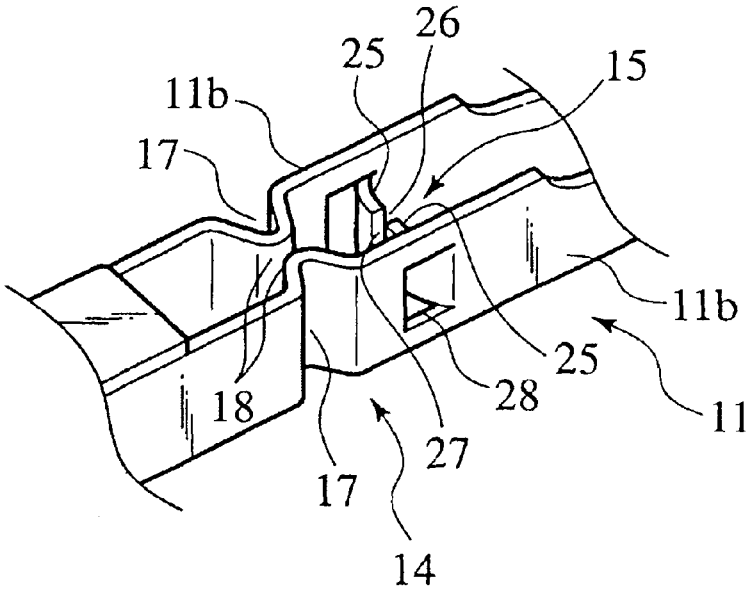
FIG. 4 is a perspective view showing other embodiment of the present invention.

As shown in FIG. 4, at the second pressure connecting portion 15, the erected pieces are formed of a pair of bent pieces 25, 25, which are formed of U-shaped cut portions 28 in the both side wall portions 11*b*, 11*b* such that they oppose each other and bending the cut portions inward so that end portions thereof oppose each other. There is formed a slit 26 between the bent pieces 25 and 25. Inside portions of this slit 26 act as connecting portions 27 which tear the coating of the coated wire wire and connecting its core to the inside portions by pressure. Meanwhile, it is permissible to provide with a plurality of the erected pieces 19 and bent pieces 25.

Because according to the example shown in FIG. 4, the erected pieces are formed only by being bent from a pair of the side wall portions 11*b*, 11*b*, production thereof is facilitated.

What is claimed is:

1. A pressure connecting terminal comprising:

an electric contact portion provided on a side thereof for contacting a mating terminal;

a pair of side wall portions formed on the other side by bending both sides of a bottom wall while an end of a coated wire being connected and conductive therewith;

a coated wire crimping portion comprising a pair of grip pieces extended from said pair of the side wall portions so that said coated wire is to be crimped;

a first pressure connecting portion provided between said coated wire crimping portion and said electric contact portion, which is located on the side of said electric contact portion and comprises a pair of punched blades each having a plated face formed by protruding said pair of the side wall portions inward, so that said coated wire is to be pressed in between said punched blades to secure conductive connection; and a second pressure connecting portion comprising an erected piece raised between said first pressure connecting portion and said pair of the grip pieces such that said erected piece is erected by being supported by said pair of the side wall portions on said bottom wall, so that said coated wire pressed in a slit formed from a top end thereof toward the bottom wall is prevented from moving in an axial direction so as to secure conductive connection, wherein said erected piece is formed by cutting said bottom wall in a U shape and raising it in the direction of an opening and has a pair of shoulder portions engaged with concave fitting grooves formed in said pair of the side wall portions, on both sides of said elected piece.

* * * * *

UNITED STATES PATENT AND TRADEMARK OFFICE

CERTIFICATE OF CORRECTION

PATENT NO. : 6,443,754 B2
DATED : September 3, 2002
INVENTOR(S) : Yuji Hatagishi and Akira Maeda It is certified that error appears in the above-identified patent and that said Letters Patent is hereby corrected as shown below:

Title page,
Item [57], ABSTRACT,
Line 8, “wall l labetween” should read -- wall lla between --.

Column 6,
Line 30, “elected piece.” should read -- erected piece. --.

Signed and Sealed this

Twenty-eighth Day of January, 2003

JAMES E. ROGAN
*Director of the United States Patent and Trademark Office*